US007269982B2

(12) United States Patent
Reese et al.

(10) Patent No.: US 7,269,982 B2
(45) Date of Patent: Sep. 18, 2007

(54) STEAM SEAL FOR TEXTILE PRODUCTION

(75) Inventors: Glen Reese, Charlotte, NC (US); James Richard Goodall, Charlotte, NC (US)

(73) Assignee: Invista North America S.AR.L, Wilmington, DE (US)

( * ) Notice: Subject to any disclaimer, the term of this patent is extended or adjusted under 35 U.S.C. 154(b) by 610 days.

(21) Appl. No.: 10/399,727

(22) PCT Filed: Nov. 14, 2001

(86) PCT No.: PCT/US01/47519

§ 371 (c)(1),
(2), (4) Date: Apr. 18, 2003

(87) PCT Pub. No.: WO02/070808

PCT Pub. Date: Sep. 12, 2002

(65) Prior Publication Data

US 2004/0000176 A1 Jan. 1, 2004

Related U.S. Application Data

(63) Continuation-in-part of application No. 09/712,331, filed on Nov. 14, 2000, now abandoned.

(51) Int. Cl.
*B08B 3/12* (2006.01)

(52) U.S. Cl. ..... 68/5 R

(58) Field of Classification Search ..... 68/5 E, 68/5 R; 34/242; 8/149.3
See application file for complete search history.

(56) References Cited

U.S. PATENT DOCUMENTS

| | | | | | |
|---|---|---|---|---|---|
| 2,260,128 | A | * | 10/1941 | Walter | 34/242 |
| 2,387,200 | A | * | 10/1945 | Walter | 8/636 |
| 2,963,001 | A | * | 12/1960 | Alexander | 118/718 |
| 3,367,667 | A | * | 2/1968 | Allen | 118/733 |
| 3,460,359 | A | * | 8/1969 | Schiffer | 68/5 R |
| 3,573,875 | A | * | 4/1971 | Zuczek | 277/399 |
| 3,640,543 | A | * | 2/1972 | Main | 277/345 |
| 3,807,059 | A | * | 4/1974 | Lopata | 34/242 |
| 3,889,495 | A | * | 6/1975 | von der Eltz et al. | 68/5 E |
| 4,407,650 | A | * | 10/1983 | Greenler | 432/242 |
| 4,437,200 | A | * | 3/1984 | Sando et al. | 15/309.1 |
| 4,442,611 | A | * | 4/1984 | Gunther et al. | 34/266 |
| 4,551,310 | A | * | 11/1985 | Imada et al. | 422/186.05 |
| 5,192,585 | A | * | 3/1993 | Inokuti et al. | 427/172 |
| 5,590,549 | A | * | 1/1997 | Alberto | 68/5 E |
| 6,334,751 | B1 | * | 1/2002 | Vanden Brande et al. | 414/217 |

FOREIGN PATENT DOCUMENTS

| | | | |
|---|---|---|---|
| SU | 753955 | * | 8/1978 |
| SU | 827646 | * | 12/1978 |

* cited by examiner

*Primary Examiner*—Michael Barr
*Assistant Examiner*—Sarah E. Husband

(57) ABSTRACT

The invention is a sealing mechanism for a steam chest (14) used in the manufacture of textile materials. This invention is a device for heating continuous textile material comprising: a steam chest (14) having a steam inlet, a material inlet (18), and a material outlet (18). A first seal means (16) is located adjacent to the material inlet (18). A second seal means (16) is located adjacent to the material outlet (19). One of the seal means (16) comprising a plurality of expansion chambers (32) located along a curvilinear path.

22 Claims, 4 Drawing Sheets

*Fig.1*
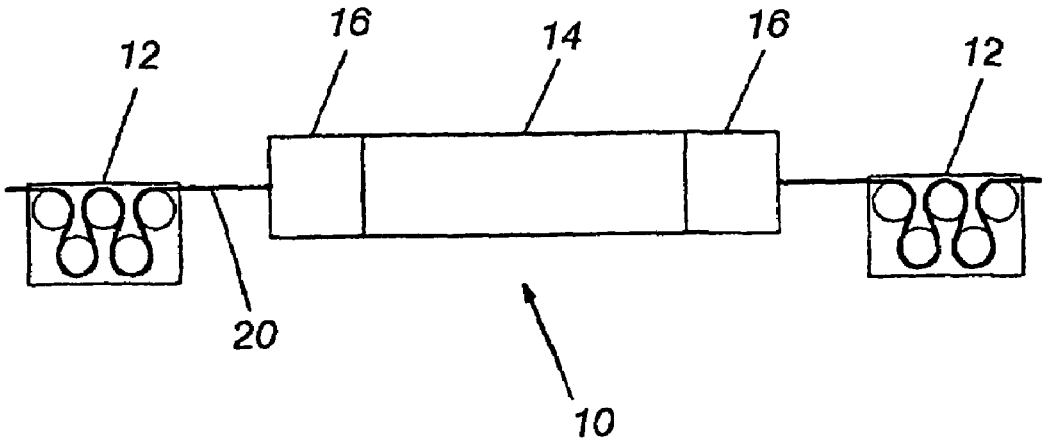
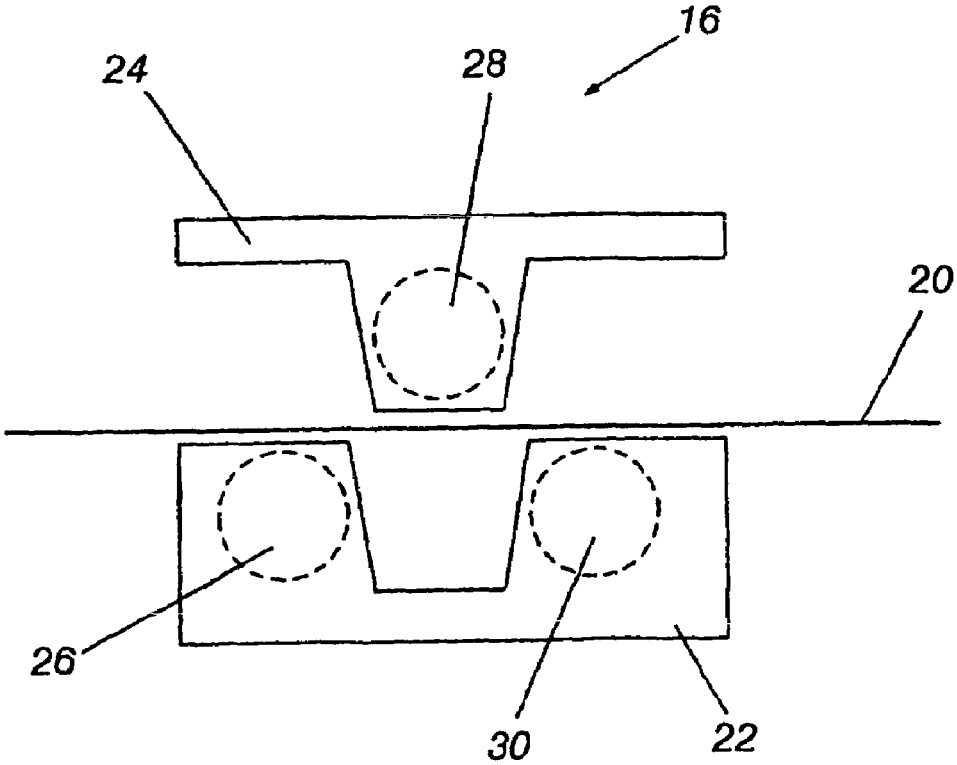
*Fig.3*

STEAM SEAL FOR TEXTILE PRODUCTION

This application is a continuation-in-part of U.S. patent application Ser. No. 09/712,331, filed Nov. 14, 2000 now abandoned.

FIELD OF THE INVENTION

This invention is directed to a sealing mechanism for a steam chest which is used in textile production.

BACKGROUND OF THE INVENTION

It is known that steam can be used to facilitate the manufacture of textile materials, e.g., fibers, yarns, filaments, tows, and fabrics. See U.S. Pat. Nos. 3,452,132; 4,639,347; 4,704,329; and the other references mentioned below, each of which is incorporated herein by reference. In general, steam treatments are used, for example, to facilitate drawing, annealing, heat setting, and/or relaxing of the textile materials. Steam treatments are also used during application of certain dyes and chemicals to textile materials, as disclosed, for example, in U.S. Pat. Nos. 3,349,578 and 3,889,495. To simplify the discussion here, the textile material described below will be a filament yarn or tow, it being understood that the apparatus and processes, set forth below, can be applied equally to other textile materials, e.g. woven or knit fabrics, which require steam treatment.

Steam treatment is the application of steam to the textile material so that heat from the steam is imparted to the material. (Steam treatment may be used to also impart heat to a dye or other chemical product being applied to a textile material and the apparatus and methods of this invention may be used in such a treatment. However, the present disclosure will focus on the steam treatment of textile material, itself.) This treatment is typically conducted in an enclosure, a steam chest. The chest has a steam inlet and two apertures through which the continuous textile material may pass, i.e. a material inlet and a material outlet. Typically, these apertures are shaped as long, narrow slits to accommodate sheet-like material, with the long dimension (length) of the aperture being in the direction of the width of said sheet-like material and the width of the aperture being in the direction of the thickness of said sheet-like material. Inside the chest, the steam comes in contact with the material and heat is transferred to the material. The heat available for transfer comes, primarily, from the condensation of the steam, and the material will acquire heat until it comes to equilibrium with the condensation temperature of the steam. So, if the process requires the material to be heated to 100° C., then steam at atmospheric pressure may be used. To attain higher temperatures, one may either use superheated steam or pressurize the chest to increase the condensation temperature. The latter is preferred. So, if the process requires a temperature of 150° C., then steam at about 476, kPa (or 54, psig) may be used.

The efficiency of the steam chest is determined by the amount of steam needed to heat the material. In practice, not all the steam entering the chest is used to heat the material because of leakage at the apertures. This leakage becomes greater as the steam pressure (i.e., the condensation temperatures) increases, so efficiency will decrease. One way of reducing leakage would be to decrease the width of the aperture, but the practical limit is that the moving material cannot contact the stationary surfaces of the aperture because of the risk of abrasion or snagging. Moreover, the material undergoes considerable vibration due to turbulence and high velocity steam escaping through the aperture. With a clearance of at least one (1) millimeter above and below the material and a pressure of about 500, kPa one could expect a steam leakage rate in excess of 50, kg of steam per hour per centimeter length of aperture. A typical commercial textile tow processing rate is about 50, kg of tow per hour per centimeter length of aperture. Accordingly, the steam leakage rate is nearly equal to the processing rate. But only about 10% of that steam is needed to heat that material to the steam condensation temperature. Therefore, this process is only about 10% efficient.

Several solutions to this leakage problem have been suggested. These solutions may be grouped into three categories. Those categories include labyrinth seals, nip roll seals, and sonic seals.

Labyrinth seals are set forth in U.S. Pat. Nos. 3,349,578; 4,332,151; 5,287,606; and Japanese Unexamined Patent Publications (Kokais) Nos. 5-33237; 5-44132; 5-339839; 6-93554; 6-57573; and 8-246330. For example, in U.S. Pat. No. 4,332,151, labyrinth seals are illustrated as tubes having a plurality of apertures through which yarn is passed into and out of the steam chest. Also see, Japanese Kokai 6-57573, labyrinth seals enclose nozzles at ends of the steam chest. Yarn may be abraded, snagged, or damaged by contact with elements of this seal, so sufficient clearance must be provided to accommodate the yarn's vibration. In the foregoing example, the clearances lead to high steam losses which can only be prevented with very long seals with a large number of chambers. Such seals are costly and lead to alignment problems.

Nip roll seals are illustrated in U.S. Pat. Nos. 3,808,845; 4,064,582; 4,111,434; 4,087,992; 4,064,713; 4,089,194; 4,184,346; and 4,949,558. For example, in U.S. Pat. No. 4,111,434, a nip roll seal mechanism is installed at the feed and takeout apertures of the steam chest. Rollers are intended to block the escape of steam from a passage which is in communication with the steam chest. The seal is formed by the nip between the rollers through which the tow passes. To minimize steam loss, the nip roll pressure must be higher than the steam pressure, and this can be a source of fiber fusion and damage.

Sonic seals are illustrated in German Patent Specification DE19546783Cl and U.S. patent application Ser. No. 09/334,140, filed Jun. 15, 1999, of Reese and Goodall. In German Patent DE19546783Cl, the device consists of an upstream jet, an injector jet, a treatment channel with no entry and exit seals, but instead three constriction zones. In operation, this arrangement of elements acts to seal the device from steam loss by developing a stationary shock wave that reduces pressure at the aperture. Such seals are useful for small scale, but are not practical for commercial lines because both capital costs and operating costs are high or prohibitive.

In view of the foregoing, there is still a need for a simple, low cost sealing mechanism which will increase efficiency and reduce noise.

SUMMARY OF THE INVENTION

The invention is a sealing mechanism for a steam chest used in the manufacture of textile materials. The term "manufacture" is intended here to include both the production of a textile material and the further treatment of a textile material, e.g. with a dye or chemical, to impart a desired characteristic thereto.

A further aspect of this invention is a device for heating continuous textile materials comprising: a steam chest having a steam inlet, a material inlet, and a material outlet. A first seal means is located adjacent to the material inlet. A second seal means is located adjacent to the material outlet. At least one of the seal means comprises a plurality of expansion chambers located along a curvilinear material path.

A still further aspect of the invention is a method for moving a textile material into and/or out of a steam chest via improved seal means.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a schematic illustration of a textile processing line with a steam chest.

FIG. 3 is an exploded view of the seal mechanism during yarn string-up.

DETAILED DESCRIPTION OF THE INVENTION

Figure 2:
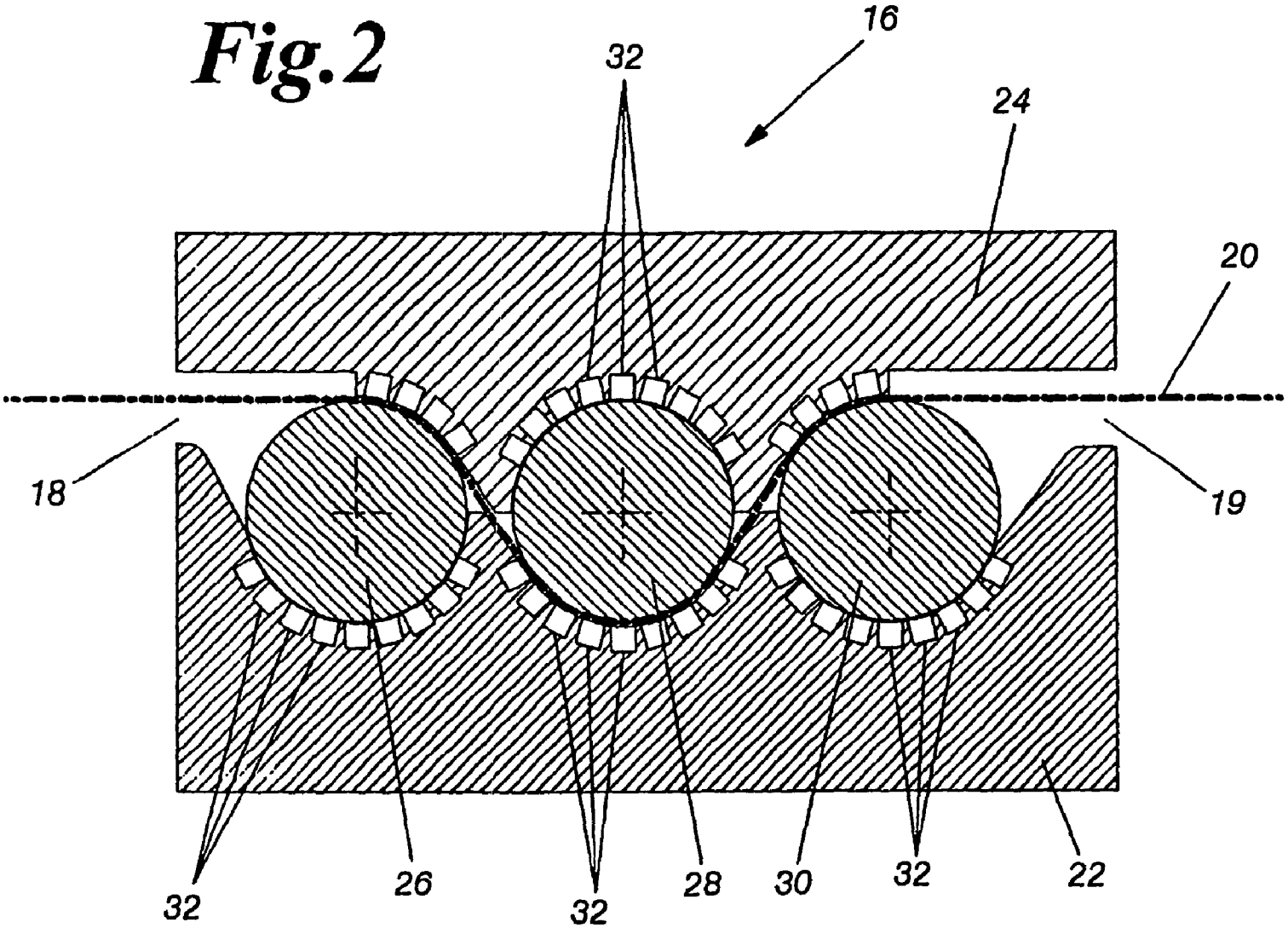
FIG. 2 is an expanded cross-sectional view of the steam chest seal mechanism.

Referring to the drawings, wherein like numerals indicate like elements, there is shown in FIG. 1 a textile processing line with a steam chest. Processing line 10 includes a pair of roller stands 12 located at either end of a steam chest 14 at a suitable distance therefrom. At either end of chest 14 are seals 16. Tow 20 is strung up through first roller stand 12, first seal 16, chest 14, second seal 16, and second roller stand 12.

While the seals are shown at the ends of the steam chest 14 according to the preferred embodiment of FIG. 1, it is to be understood that one or both of them may be located on the side of a steam chest, like the sealing devices of U.S. Pat. No. 3,349,578, the disclosure of which is incorporated herein by reference.

The seals 16 may be outside the body of the steam chest 14. In accordance with this embodiment they may be joined in a sealed union to the steam chest by suitable means, such as flanges and bolts (not shown). Enclosures are thereby formed wherein, respectively, the first and second seals 16 communicate with the steam chest 14 and the material inlet of the steam chest is suitably aligned with a material outlet at the downstream end of the curvilinear material path of the first seal 16 to receive material, e.g. a tow, therefrom and a material inlet at the upstream end of the curvilinear path of the second seal 16 is suitably aligned with the material outlet of the steam chest to receive material therefrom.

In accordance with another embodiment of the invention, a seal 16 may be located within the body of the steam chest 14 at each end thereof. The upstream end (relative to the direction of movement of a textile material therethrough) of the curvilinear material path of the first seal 16 is suitably aligned with the material inlet of the steam chest so that material entering the steam chest can be drawn into and through the first seal and the downstream end of the curvilinear material path of the second seal is suitably aligned with the material outlet of the steam chest for transport of a textile material from the former and through the latter.

Referring to FIG. 2, seal 16 comprises a lower frame 22 and an upper frame 24. Rollers 26, 28, and 30 are held within seal 16 and are adapted for allowing tow 20 to pass over their respective surfaces. Surrounding each roller are a plurality of expansion chambers 32. There is a clearance between the rollers and expansion chambers which is sufficient so that the tow may pass freely through seal 16, that is the tow will not be abraded, snagged, or damaged by elements of the seal. The clearance between the roller surface and expansion chambers is preferably no more than about 1, mm over the height, i.e. thickness, of the tow on the roller. Expansion chambers 32 may be sized in a known manner. See: Egli, A., "The Leakage of Steam Through Labyrinth Seals," 1935, Transaction of the American Society of Mechanical Engineers, Vol. 57, p. 115-122; and Kearton, W. J., et al, "Leakage of Air Through Labyrinth Glands of Staggered Type," 1952, P.I. Mech Eng A-J Pow Vol. 166, p. 180-195, both of which are incorporated herein by reference.

Lower frame 22 and upper frame 24 are disposed opposite one another and comprise the bottom closure and the top closure, respectively, of seal 16. In addition, each frame comprises parts of the sidewalls of the seal, as shown in FIG. 3, which parts fit together in sealing relationship to form complete side closures for the seal 16, when upper frame 24 is lowered onto lower frame 22.

Each of frames 22 and 24 may be comprised of sections which are held together by suitable means, such as bolts, and can be separated for convenience in installing and removing rollers. Three such sections are shown in FIGS. 4-7, although a different number may be employed. Other arrangements may also be employed.

The term "Surrounding" as set forth above and hereinafter is not intended to mean that each of rollers 26, 28 and 30 is completely encircled by a plurality of expansion chambers 32. Rather, as shown in FIG. 2, there are gaps between the underside of the top closure and the top side of the bottom closure. Of these gaps, the ones between the ends of these closures, i.e. between the opposing ends of frames 22 and 24, define separately an inlet 18 and an outlet 19 in opposite ends of seal 16 for travel of a textile material, e.g. a tow, into and out of the seal 16 which is preferably closed except for said inlet and outlet, and the gaps located between the rollers are adapted to allow the tow to extend from the surface of each roller to the surface(s) of the roller(s) adjacent thereto. All of these gaps are of sufficient length and width to permit a textile material being processed in the seal 16 to be transported freely therethrough without being excessively abraded, snagged or damaged and, preferably, without contacting the surfaces of frames 22 and 24. Each plurality of expansion chambers surrounding a roller comprises a first plurality of expansion chambers which is within the portion of the upper frame adjacent to said roller and partially surrounds said roller along the upper portion thereof and a second plurality of expansion chambers which is within the portion of the lower frame adjacent to said roller and partially surrounds said roller along the lower portion thereof. Each end of each first plurality of expansion chambers is separated from the adjacent end of the second plurality of expansion chambers around the same roller by one of said gaps. The adjacent ends of a first and second plurality of expansion chambers partially surrounding the same roller are the ends which are both nearer to the inlet or both nearer to the outlet of the seal. By "ends" here is meant the outermost sides of the outside expansion chambers in each plurality of expansion chambers.

Also, in accordance with the embodiment of the invention shown in FIG. 2 the tow 20 does not travel between each roller and both the first and second pluralities of expansion chambers which partially surround it. Rather, the seal 16 is adapted for travel of the tow along a sinuous path which takes it through a first set of clearances. The first set of clearances comprises the clearance between the upper portion of roller 26 and the expansion chambers in the portion of upper frame 24 adjacent said upper portion of roller 26 and the clearance between the lower portion of adjacent roller 28 and the expansion chambers in the portion of lower frame 22 adjacent to said lower portion of roller 28. A second set of clearances comprises the clearance between the lower portion of said roller 26 and the expansion chambers in the portion of lower frame 22 adjacent to said lower portion of roller 26, and the clearance between the upper portion of adjacent roller 28 and the expansion chambers in the portion of upper frame 24 adjacent to said upper portion of roller 28. The second set of clearances need not be adapted for travel of a tow therethrough and the height of each of such clearances may be less than that of the first set of clearances, e.g. by an amount equal to about the thickness of the tow to be treated.

In the embodiment shown in FIG. 2 each of frames 22 and 24 has an inner side, i.e. the top side of the bottom closure and the underside of the top closure, respectively, which has portions which are each adjacent to and opposite a portion of the surface of a roller 26,28 or 30 and on which is located one of the first or second pluralities of expansion chambers 32 discussed above. Each pluralities of expansion chambers is defined by a series of alternating recessed and non-recessed surfaces, with the non-recessed surfaces being closer than the recessed surfaces to the adjacent roller surface. Each expansion chamber comprises a recessed surface, opposing side walls connecting said recessed surface to a non-recessed surface on either side thereof, and an open end which is opposite to the recessed surface and faces the roller surface nearest thereto. The shortest distance between each non-recessed surface and the closest point of the roller surface opposite thereto is preferably the same and defines the height of the clearance between said roller surface and the expansion chambers.

Each expansion chamber 32 extends parallel to the longitudinal axis of the roller to which it is adjacent and has a length which, preferably, is substantially at least as long as that portion of the total length (end to end) of said roller which is adapted for contact with the textile material to be transported therethrough. Put another way, the length of each expansion chamber is preferably at least as great as the width of the towband or other textile material as transported through the seal 16.

Each first and/or second plurality of expansion chambers 32 may be a separate unit which is attached to frame 24 or 22, respectively. However, it is preferably an integral part of the frame. More preferably, each expansion chamber 32 comprises a groove in the surface of the inner side of a frame 22 or 24, whereby the deepest portions of the grooves comprise the recessed surfaces and the lands between adjacent grooves comprise the non-recessed surfaces of each plurality of expansion chambers.

Each plurality of expansion chambers is disposed along a curve opposite a portion of the surface of a roller adjacent thereto. Preferably, the non-recessed surfaces of which each plurality of expansion chambers is comprised, as described above, is disposed along a segment of a circle which has a slightly larger radius than and is substantially concentric with said roller. More particularly, each first and second plurality of expansion chambers preferably forms a segment of a right circular cylinder which has a slightly larger radius than and is concentric with the adjacent roller. The difference between the radius of said circle or the internal radius of said cylinder and the radius of the adjacent roller constitutes the clearance between the roller surface and the expansion chamber discussed above.

Preferably, each first and second plurality of expansion chambers is opposite a segment of the circumference of the roller to which it is adjacent, which segment is at least about 50°. More preferably, each first and second plurality of expansion chambers which is adjacent to the portion of a roller which is adapted to be in contact with the tow during its passage through the seal 16 is opposite to substantially the entire segment of the surface of said roller with which the tow is in contact at any given instant.

The rollers 26, 28 and 30 are parallel to one another along their longitudinal axes, which axes are preferably disposed generally horizontally within the seal 16. Said longitudinal axes are disposed transversely, particularly perpendicularly, to the direction of transport of the tow from the inlet to the outlet of the seal. Typically, each roller extends substantially from sidewall to sidewall of the frame 22 or 24 by which it is supported, with sufficient spacing between each end of each roller and the respective adjacent sidewall to avoid excessive friction and/or wear without permitting excessive leakage of steam through the seal 16. However, other arrangements are possible, such as that shown in FIG. 4, discussed below, wherein each roller extends to cheek plates disposed between each end of the roller and the adjacent sidewall of the frame in which it is supported. The longitudinal axes of the rollers may be in the same horizontal plane, as shown in FIG. 2, or they may be staggered. The circumference of each roller may be the same, as shown in FIG. 2, or the circumferences may differ from one another.

Because of the sealing effect provided by each combination of a plurality of expansion chambers 32 and the roller 26, 28 or 30 to which it is in closest proximity, it is not necessary that the rollers which are adjacent to one another be in contact with each other, much less in pressure contact as in nip roll seals discussed above. Rather, adjacent rollers may be, and preferably are, spaced from one another as shown in FIG. 2. More preferably, all of the rollers within the seal 16 which are adjacent to each other and are adapted for passage of a tow 20 between them are spaced from one another by a distance such that directly opposite portions of the opposite sides of the tow, when passing between pair of such adjacent rollers, will not be simultaneously in contact with the surfaces of both rollers. This can be achieved by spacing the rollers from one another by a distance greater than the thickness of the tow which said rollers are adapted to have pass over their respective surfaces.

The seals 16 abut the chest 14 and form a fluid tight seal therebetween. The steam's only escape paths are along the curvilinear paths, those curvilinear paths being defined by the surfaces of rollers 26, 28, 30. While three rollers are preferred, it is understood that as few as two rollers, or more than three rollers could also work, the tradeoffs being cost for efficiency.

In operation, textile material to be treated or which has been treated in a vessel containing a gas, especially steam, under elevated pressure is drawn into or from the vessel through the sealing device ("seal") of the present invention at the inlet and/or outlet of said vessel. Within the sealing device the material passes in a sinuous path over the surface of a portion of a first roller and then over the surface of a portion of an adjacent second roller through clearances between said surfaces and the plurality of expansion chambers adjacent to the respective roller which forms with that respective roller a curvilinear labyrinth seal. Preferably, each first and second plurality of expansion chambers along a curvilinear path defined by the surface of a roller forms with that roller a curvilinear labyrinth seal.

By supporting the tow on the roller surfaces, the vibration of the tow is substantially reduced or eliminated. As a result, the clearances may be significantly reduced. By making the clearances smaller, the apertures through which steam escapes are made smaller. The loss rate through the seal is directly proportional to the size of the aperture. Therefore, by reducing the aperture size by half one can decrease the loss rate of the seal by half. The curvilinear path also improves the efficiency of the expansion chambers relative to that of a linear labyrinth seal where all the steam apertures are aligned in a straight line. The purpose of each chamber is to permit the forward velocity of the escaping steam to dissipate, so that the kinetic energy from one aperture is not carried into the next. The curvilinear arrangement of apertures prevents the steam escaping from one aperture from impinging directly into the following one. The expansion chambers can preferably be shorter and more numerous than in a linear array, providing more efficiency within a given space. Therefore, the efficiency of the steam chest is increased by the seal.

In FIG. 3, seal 16 is shown during string up. Lower frame 22 carries rollers 26 and 30 while upper frame 24 carries roller 28. Frames 22 and 24 are separated so that tow 20 may be placed therebetween. Then, upper frame 24 is lowered onto lower frame 22, thereby providing string up of the tow.

During operation, the tow tends to spread out over the roller surface, and may fall off the surface and into the bearings supporting the rollers. In FIGS. 4-7, four alternative embodiments are illustrated to lessen or prevent the movement of the tow off the roller surface. These embodiments are, for simplicity, shown only used on one roller, it being understood that these mechanisms could be used on any or all of the rollers. Each of these Figures is a lateral vertical cross section of a seal 16 through the longitudinal axis of roller 26. The axle 34 is shown as being integral with, i.e. one piece with, the roller, but it could be a separate piece which is adapted to turn with roller. The roller is supported in frame 22 by bearings 50 on which the axle turns. The lines AA and BB indicate where the three sections of frame 22 are joined together. In each of these embodiments the expansion chambers are between the means for lessening or preventing the movement of the tow off the roller surface.

Figure 4:
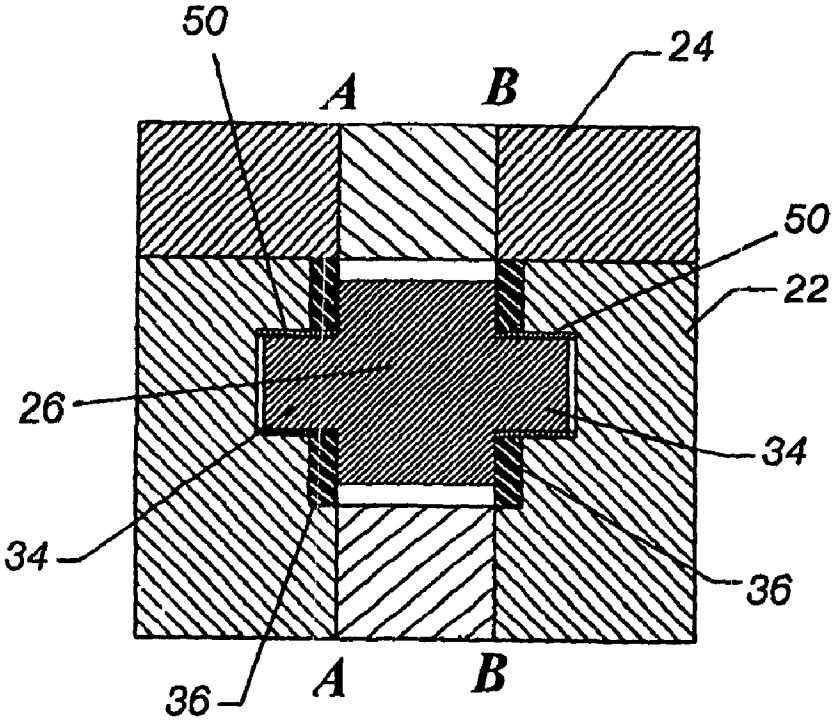
FIG. 4 is an illustration of a first more preferred embodiment of the seal mechanism.

In FIG. 4, a cheek plate 36 is located between an end of roller 26 and frame 22. Cheek plate 36 is in bearing engagement between roller 26 and frame 22, and is adapted to wear while preventing tow from contacting axle 34. Cheek plate 36 also seals against steam loss between axle 34 and frame 22. Preferably, as shown, there is a cheek plate between each end of roller 26 and frame 22.

Figure 5:
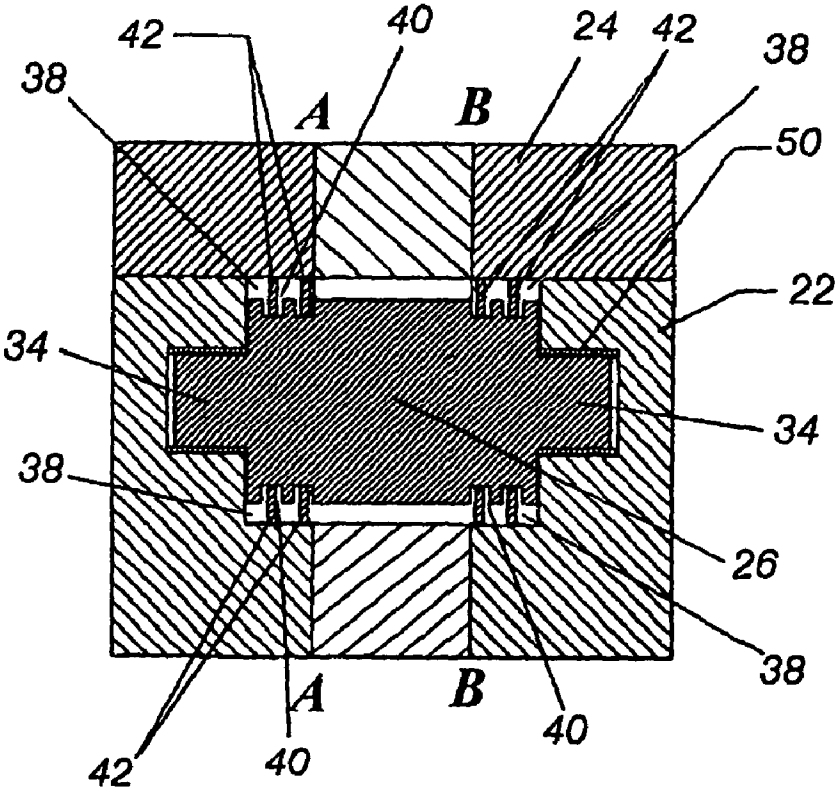
FIG. 5 illustrates a second more preferred embodiment of the seal mechanism.

In FIG. 5, a labyrinth seal 38 is used. Labyrinth seal 38 comprises a groove 40 cut into the surface around the circumference of roller 26, and annular plate 42 which is mounted on frames 22 and 24, perpendicular to axle 34, and extends into groove 40. Annular plate 42 is in two aligned sections, each of which is mounted to a different one of frames 22 and 24 to permit separation of frames 22 and 24 as shown in FIG. 3. Preferably, as shown, there is a labyrinth seal 38 near each end of roller 26. Also as shown, each labyrinth seal 38 may comprise more than one groove 40 and plate 42.

Figure 6:
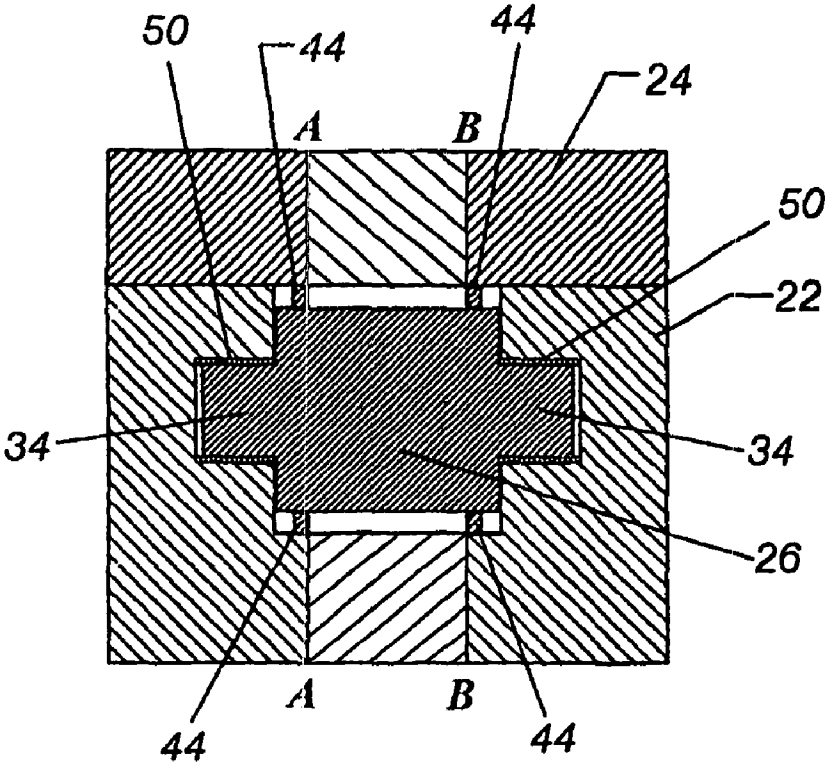
FIG. 6 illustrates a third more preferred embodiment of the seal mechanism.

In FIG. 6, sealing rings 44 are mounted on frames 22 and 24, perpendicular to axle 34, and are adapted for bearing engagement with the surface of roller 26. Each sealing ring 44 is in two vertically aligned sections with the two sections of each ring being mounted to one of frames 22 and 24 to allow for separation of the frames.

Figure 7:
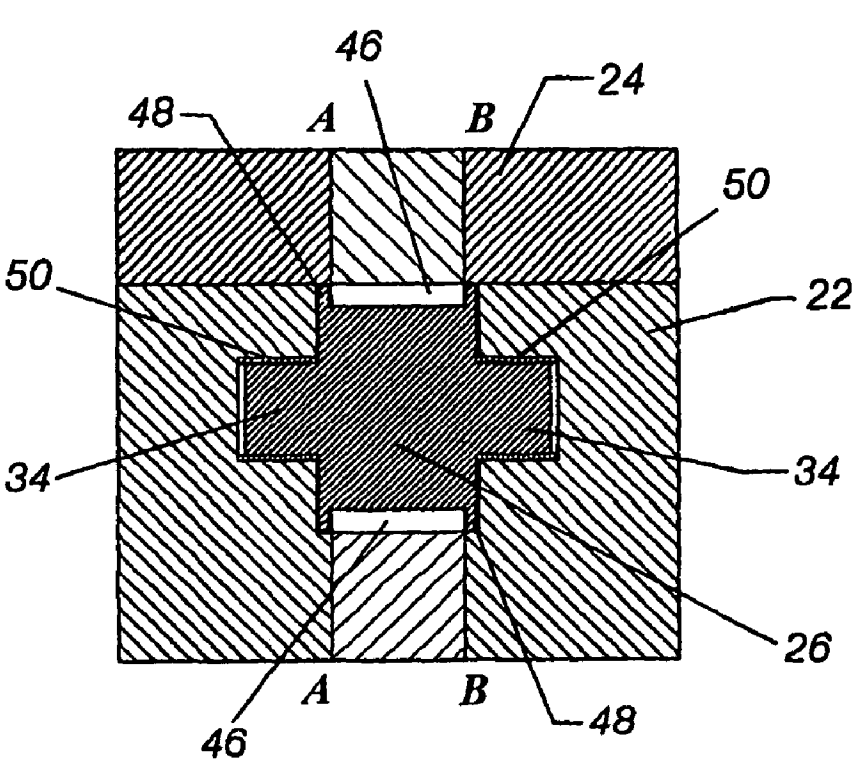
FIG. 7 illustrates a fourth more preferred embodiment of the seal mechanism.

In FIG. 7, roller 26 may be formed by cutting a channel 46 into a larger roller leaving a roller 26 having raised flanges 48 along its shoulders. Alternatively, flanges may be fastened to the roller 26 at each end thereof. The flanges are in bearing engagement with frames 22 and 24. The flanges hold the tow on the surface of roller 26. The clearances between the roller surface and the pluralities of expansion chambers, as described throughout this specification, are the same for this roller and are measured from the portion of the surface between the flanges.

Finally, another embodiment to lessen or prevent the movement of the tow off the roller surface (not illustrated) involves the fluid pressurization of the space between the lateral side of the roller and the frame. The pressure may be generated from the primary steam supply.

Another feature which has been tried but is not currently preferred is to mount a vertical guidepost for the tow on either side of the outlet on the exterior of the outlet end of the seal.

As discussed above, the apparatus and methods of this invention to other textile materials besides tow, including forms of textile material which may not tend to fall off the roller surface. Accordingly, it is to be understood that the present invention includes embodiments which do not include mechanisms, such as those shown in FIGS. 4-7, for lessening or preventing movement of a tow off the roller surface.

While the present disclosure has been directed to the applicability of the present invention to steam treatment, it is believed that it is further applicable to the sealing of vessels containing other fluids besides steam which are under elevated pressure.

The entire disclosure of U.S. patent application Ser. No. 09/712,331, filed Nov. 14, 2000, is incorporated herein by reference.

The present invention may be embodied in other specific forms without departing from the spirit or essential attributes thereof such as, for example the upper frame 24 and the lower frame 22 could be reversed (frame 22 on top of frame 24), or side-by-side (i.e. left frame 22 and right frame 24, or vice versa), with the other parts of the seal being oriented accordingly. Therefore, reference should be made to the appended claims, rather than to the foregoing specification, as indicating the scope of the invention.

We claim:

1. A device for heating continuous textile material which comprises:

a steam chest having a steam inlet, a material inlet, and a material outlet;

a first seal located adjacent to said material inlet;

a second seal located adjacent said material outlet;

at least one of said first seal or said second seal comprising at least one roller defining a curvilinear path material; and a plurality of expansion chambers, said plurality of expansion chambers being disposed radially around each said at least one roller along said curvilinear material path through which said textile material travels.

2. The device of claim 1 further comprising means for preventing material slippage off the material path.

3. A device for heating a continuous textile material which comprises:

a steam chest having a steam inlet, a material inlet, and a material outlet;

a first seal located adjacent to said material inlet;

a second seal located adjacent to said material outlet;

at least one said first or second seal comprising first and second rollers, and first and second frames said first roller carried by said first frame said second roller carried by said second frame, said material entering said seal and being supported on said rollers so as to define a curvilinear material path therethrough;

at least one of said first or second seal comprising a plurality of expansion chambers located along a curvilinear path, said plurality of expansion chambers comprising parallel grooves disposed radially around each at least one said first or second roller along said curvilinear material path through which said textile material travels.

4. The device of claim 3, further comprising means for preventing material slippage off a roller supporting said material.

5. The device of claim 4, wherein said means for preventing material slippage off a roller comprises a labyrinth seal between said roller and said frame in which it is carried.

6. The device of claim 4, wherein said means for preventing material slippage off a roller comprises a check plate between said roller and said frame in which it is carried.

7. The device of claim 4, wherein said means for preventing material slippage off a roller comprises a channel in said roller.

8. The device of claim 4, wherein said means for preventing material slippage off a roller comprises pressurizing a space, said space being defined between a lateral side of said roller and said frame.

9. A sealing device for a steam chest useful in the manufacture of textile materials, said sealing device comprising at least one roller defining a curvilinear material path, and a plurality of expansion chambers disposed radially around each said at least one roller along said curvilinear material path through, which said textile material travels.

10. A sealing device according to claim 9, wherein said curvilinear material path is defined by a plurality of rollers within said sealing device.

11. A sealing device according to claim 9, which comprises first and second frames and first and second rollers, wherein a first plurality of expansion chambers is disposed within said first frame and partially surrounds said first roller, and a second plurality of expansion chambers is disposed within said second frame and partially surrounds said second roller, which is adjacent to said first roller, each of said first roller and said second roller having its longitudinal axis disposed horizontally within the sealing device.

12. A sealing device according to claim 10 which comprises a top closure, a bottom closure and two opposing side closures and wherein said plurality of expansion chambers comprises first and second sets, said first set of expansion chambers disposed in the underside of the top closure adjacent to the surfaces of said rollers and said second set of expansion chambers is disposed in the top side of the bottom closure adjacent to the surfaces of said rollers.

13. A sealing device according to claim 12 wherein each said expansion chambers has an open side which faces the surface of one of said rollers.

14. A sealing device for inhibiting the passage of a gas therethrough while allowing passage of a textile material therethrough, said device comprising: an upper frame and a lower frame which together comprise a structure having a top closure, a bottom closure, mutually opposing side closures connecting said top and bottom closures and two mutually opposing ends, each end having an opening defining, respectively, an inlet and an outlet for said textile material, an interior space defined by said closures and said ends, a plurality of rollers within said interior space, said rollers having parallel longitudinal axes disposed horizontally and perpendicular to said side closures, at least one of said rollers defining a curvilinear material path, a first plurality of expansion chambers in said upper frame within said interior space comprising parallel grooves extending parallel to the longitudinal axes of the rollers and disposed along a curve uniformly spaced from and partially surrounding a first one of said rollers so as to form a curvilinear labyrinth seal along said curvilinear material path, and a second plurality of expansion chambers in said lower frame within said interior space comprising parallel grooves extending parallel to the longitudinal axes of the rollers and disposed along a curve uniformly spaced from and partially surrounding a second one of said rollers adjacent to said first one of said rollers so as to form a curvilinear labyrinth seal along said curvilinear material path through said textile material travels.

15. A sealing device according to claim 14, wherein each of the upper and lower frames is in three sections which are joined together but which are separable from one another.

16. A sealing device according to claim 14, which comprises means for preventing slippage of material off the roller mounted both on the top frame and on the bottom frame, said means for preventing slippage of material off the roller together form a sealing ring around the circumference of the roller.

17. A sealing device according to claim 16 wherein the means for preventing material slippage off the roller comprises raised portions of the roller at each shoulder thereof.

18. A method for introducing a continuous length of textile material into or removing said textile material from a vessel containing a gas under elevated pressure which comprises passing the textile material through a sealing device comprising at least one roller defining a curvilinear material path, and a plurality of expansion chambers disposed radially around each said at least one roller along said curvilinear material path through which said textile material travels.

19. A sealing device for a steam chest useful in the manufacture of textile materials, said sealing device comprising a first frame and a second frame which together form a structure having a material inlet and a material outlet, a first roller and a second roller within said structure, a first plurality of expansion chambers disposed within said structure and partially surrounding said first roller disposed radially around said first roller along a curvilinear material path, and a second plurality of expansion chambers disposed within said structure and partially surrounding said second roller disposed radially around said second roller along a curvilinear material path through which said textile material travels, wherein said first and second plurality of expansion chambers comprise parallel grooves.

20. A sealing device according to claim 19 wherein said structure is closed, except for said inlet and said outlet, and wherein the longitudinal axis of each of said first and second rollers is disposed horizontally and perpendicular to the direction from said inlet to said outlet.

21. A sealing device according to claim 19, wherein each of said first plurality of expansion chambers and said second plurality of expansion chambers is disposed along a curve, which is uniformly spaced from the surface of the roller which it partially surrounds.

22. A sealing device according to claim 19, wherein each of said first plurality of expansion chambers and said second plurality of expansion chambers forms, with said roller which said first plurality of expansion chambers or said second plurality of expansion chambers partially surrounds, a curvilinear labyrinth seal.

* * * * *